US009091503B2

(12) United States Patent
Howard

(10) Patent No.: US 9,091,503 B2
(45) Date of Patent: Jul. 28, 2015

(54) V-LIMB

(71) Applicant: Robert Scott Howard, Jacksonville, FL (US)

(72) Inventor: Robert Scott Howard, Jacksonville, FL (US)

( * ) Notice: Subject to any disclaimer, the term of this patent is extended or adjusted under 35 U.S.C. 154(b) by 198 days.

(21) Appl. No.: 13/986,707

(22) Filed: May 28, 2013

(65) Prior Publication Data

US 2014/0352678 A1 Dec. 4, 2014

(51) Int. Cl.
*F41B 5/10* (2006.01)

(52) U.S. Cl.
CPC ..... *F41B 5/10* (2013.01)

(58) Field of Classification Search
CPC ..... F41B 5/10
USPC ..... 124/25.6, 86
See application file for complete search history.

(56) References Cited

U.S. PATENT DOCUMENTS 3,989,026 A * 11/1976 Nishioka ..... 124/25.6
4,078,538 A * 3/1978 Shepley ..... 124/25.6
4,662,344 A * 5/1987 Mitchell ..... 124/22
4,926,833 A * 5/1990 Darlington ..... 124/23.1
5,433,792 A * 7/1995 Darlington ..... 124/25.6
5,507,270 A * 4/1996 Smith ..... 124/23.1
5,979,425 A * 11/1999 Loomis ..... 124/25.6
6,024,076 A * 2/2000 Laborde et al. ..... 124/23.1
6,712,057 B2 * 3/2004 Andrews ..... 124/23.1
7,832,387 B1 * 11/2010 Yehle ..... 124/25.6
8,776,770 B2 * 7/2014 Batdorf ..... 124/23.1
2010/0116260 A1 * 5/2010 Malucelli ..... 124/25.6
2012/0006310 A1 * 1/2012 Sims et al. ..... 124/25

* cited by examiner

*Primary Examiner* — Joshua Kennedy

(57) ABSTRACT

The apparatus disclosed is intended to maximize archery artisans arrow speed by replacing the traditional flat archery bow limb with a new and unique shaped V-Limb, said V-Limb is a composite material designed in an archedly ridged fashion and is capable of retaining more of the internal lateral force tension created by the effects of bending an obtuse angled bow limb then a traditional flat archery bow limb. In addition, said V-Limb has adjustable axle to axle lengths and adjustable brace heights, both of which are currently non-existent. Furthermore; V-Limb's unique x-axis shape resist vibration from torsion and limits the amount of torsion received from cam torsion resulting from string pull while providing said archery artisan a straighter string path resulting in a faster projectile.

1 Claim, 6 Drawing Sheets

V-LIMB

CROSS REFERENCE TO RELATED APPLICATIONS

This application claims the benefit of a U.S. Provisional Application Titled 61/854,807 filed May 2, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates generally to the U.S. patent classification definitions technical field of but not limited to; Class 273 Archery/Subclass 317+ and Class 124 Mechanical guns and projectors/subclass 23.1 bow, subclass 25 crossbow, subclass 25.6 compound bow.

PRIOR ART

Archery in its purest form has long been associated with the Native American bow and arrow, and while the newest style of bow is the compound bow, it was invented in the mid-20th century with $20^{th}$ century technology. Said compound bow consisted of steel pulleys and/or cams on the ends of the staves, with a long string that criss-crosses the bow multiple times. One limb usually has an elliptical cam, which produces a sudden reduction in the draw weight of the bow when a certain point is reached. Another form had double elliptical cams but had timing problems. Bow material was commonly wood or fiberglass. Computer software had yet to be invented that could demonstrate stress and g-force generated upon staves, strings and elliptical pulleys. Arrow speed was comparably slow at 200 fps and archery bows had a typical "C" shape. Typically, archery bows described can be bought in expensively.

In the $21^{st}$ century, computers and software technology have advanced archery as archery equipment has seen dramatic advances in aluminum and magnesium composite limb systems, parallel limb design, limb turrets, cam module, idler module, carbon tension cable and strings, power and buss cables, cable and string suppressors, inertia tungsten carbide weight disks embedded into cams and string grubs. The aforementioned advances and innovations have brought the modern compound bow to where it is today. Arrow speeds now reach 340 fps, computerized numerical controlled machines bend, form or vacuum composite material into variations of rectangular shapes with beyond parallel dual limbs tipped with cam modules, idler modules, string suppressors etc.

While archery equipment and compound bow performance advances have continued to rise, so has the price of this $21^{st}$ century technology, high performance archery bows cost upwards of $1,200. While there do exist many fanciful apparatus that will attach in all manners to an archers bow, they all have similar shortcomings which is none provide axle to axle adjustment nor adjustable brace heights. Also, other problems associated with prior art archery bows such as but not limited to, a small expansion and compression area on the limb; and upper limb and lower limb torsion (limb roll); and cam torsion (cam lean); and string oscillation in the string path; and vibration caused by oscillation of limbs during and post projectile release; and the narrow limb profile which limits advertising and branding surface area.

Additionally, said prior art fails to take advantage of opposing lateral forces working against each other to create a more powerful bow limb capable of delivering greater tension to the archers bow string thus supplying a greater thrust to the archers arrow; in short, greater feet per second speed of the archers arrow.

Accordingly, a need remains for ARCHERY BOW V-LIMB in order to overcome the above-noted shortcomings. The non-limiting exemplary embodiments satisfies such a need by providing an apparatus that is convenient and easy to use, lightweight yet durable in design, versatile in its applications, and designed for easily and conveniently adjusting the axle to axle length and adjusting brace heights on archery bows. Additionally, said invention allow less torsion to transfer into said limb which reduces torsion on said cam, resulting in less said string friction which result in a faster projectile.

BRIEF SUMMARY OF THE INVENTION

In view of the foregoing background, it is therefore an object of the non-limiting exemplary embodiments to provide a brief summary of the invention and some of the advantages such as an archery bow limb capable of retaining more of the internal lateral force tension created by the effects of bending an obtuse angled bow limb than a traditional flat archery bow limb; and another advantage is an archery bow limb having adjustable axle to axle lengths and; an additional advantage is having an adjustable brace height; and a further advantage is having a fulcrum point.

Described in one embodiment is the fabrication of said invention.

An additional embodiment of the invention describes the apparatus as said material is waterproof, rugged, formable and ridged.

An adjustable axle to axle length is described in another embodiment of the invention.

In still another embodiment is described an adjustable brace height.

An additional embodiment describes said invention attaching by such as but not limited to, a limb to riser compression plate fastener.

A further embodiment is a description of the shape used to maximize spring return ratio.

Another embodiment discloses a unique method of attaching said invention to a riser.

This invention does not interfere with field adjustments to neither the cam module nor the idler module These and other objects, features, and advantages of the invention are provided by description of the preferred embodiments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
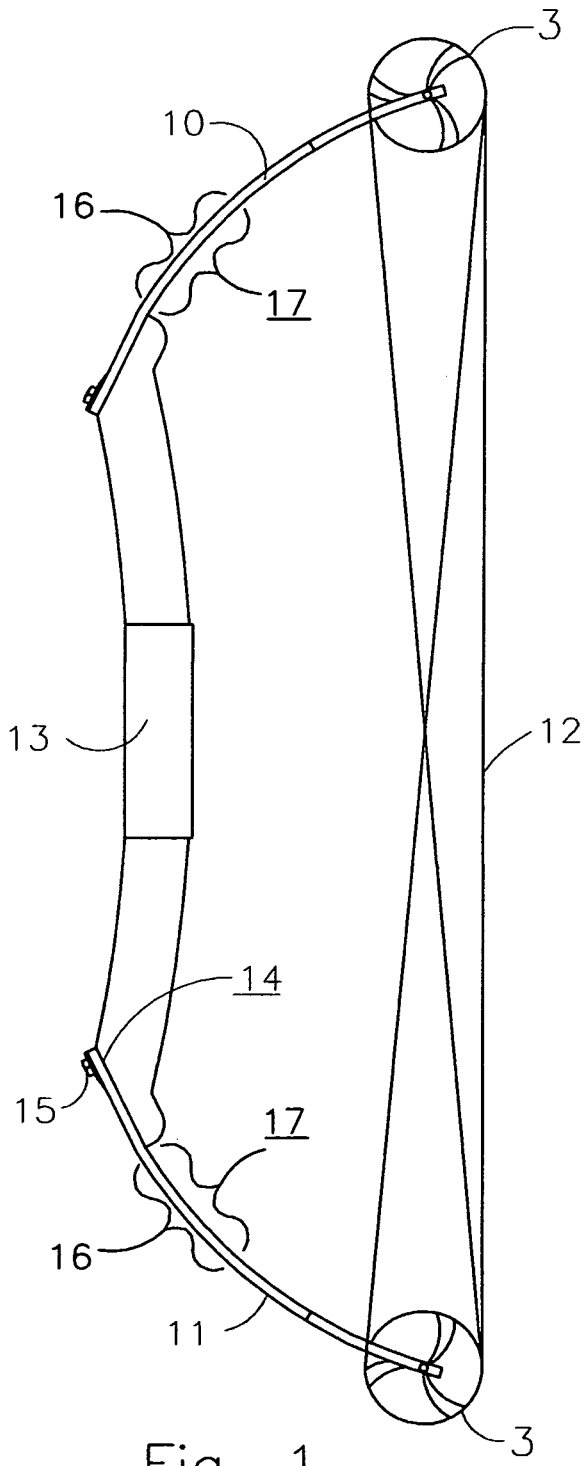
Fig. 1 PRIOR ART
FIG. 1 is a side view showing prior art, to better acquaint the reader with traditional archery equipment, and having a flat limb leg 10 and a opposed flat limb leg 11 sandwiching a riser 13 and attached to said riser 13 with both a nut 14 and a bolt 15. Said legs 10 and 11 having a 3 cam 3 located opposite riser 13 and connected with a string 12. Said string 12 attaches to string mount not shown) located on side said cam 3 by a means and routes around said cam 3 in a track and routes onto opposite limb and cam 3 and into said string mount (not shown). Also viewed flat limb expansion area 16 and flat limb compression area 18.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The non-limiting exemplary embodiments will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "non-limiting exemplary embodiments" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the non-limiting exemplary embodiments. Thus, to the maximum extent allowed by law, the scope of the non-limiting exemplary embodiments is to be determined by the broadest permissible interpretation of the following claims and their equivalents, and shall not be restricted or limited by the foregoing detailed description.

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "non-limiting exemplary embodiment" in various places in the specification are not necessarily all meant to refer to the same embodiment.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

Figure 3:
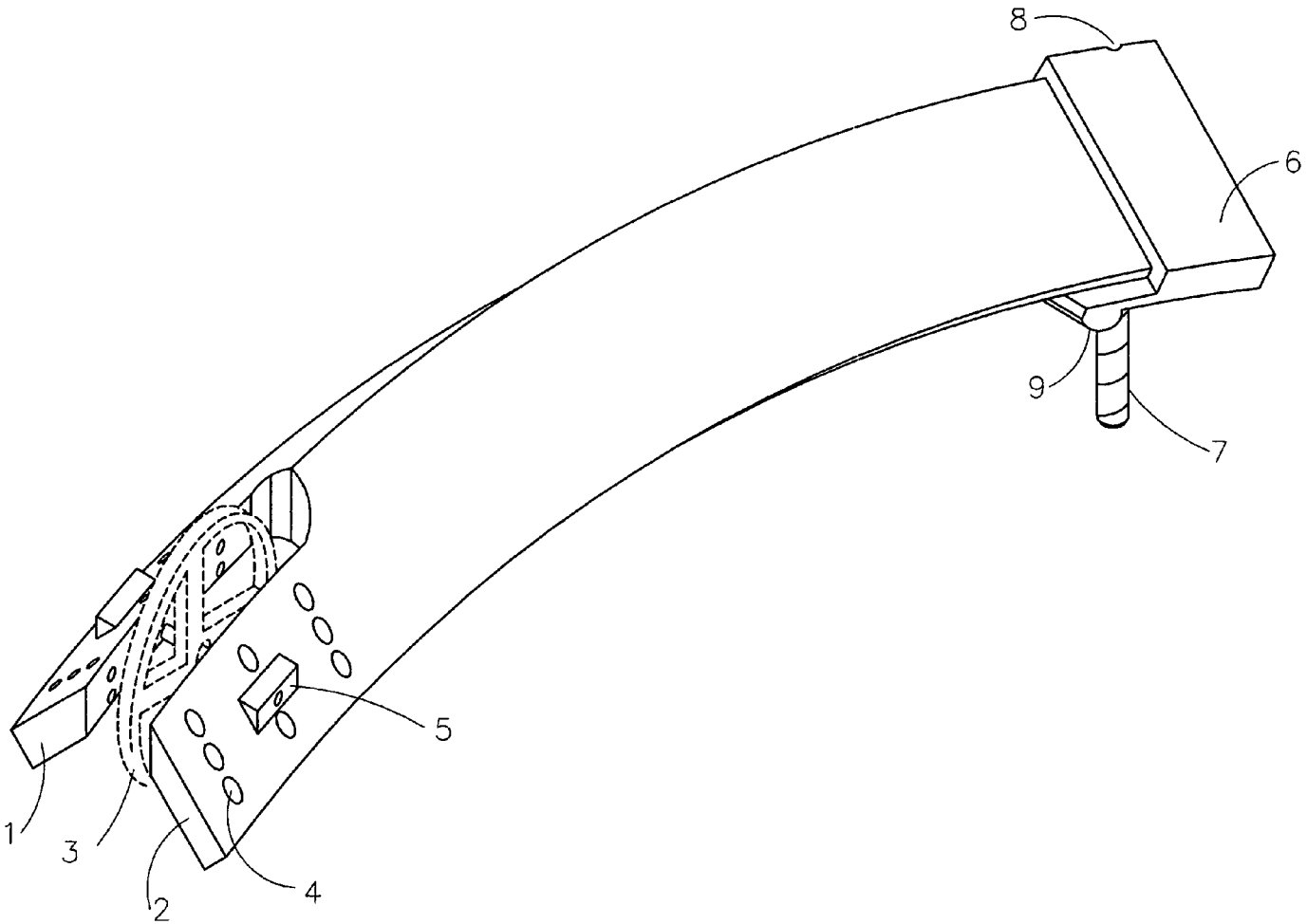
FIG. 3 is a perspective view of the invention with said limb to riser compression plate 6, viewed from the cam yoke end and showing said vertical and horizontal adjustment ports 4 and cam axle mount 5.

The apparatus of this invention is referred to generally in FIG. 3 and is intended to provide a perspective view showing the invention attached to a common 21$^{st}$ century high performance compound bow. It should be understood that the non-limiting exemplary embodiments may be used to describe similar apparatus and many different types of devices that could be protected by and utilize said invention and should not be limited to the uses described herein. The descriptor nomenclature legend that follows is not meant to be all encompassing but to aid the reader in understanding the figures within the drawings.

limb leg 1;
opposed limb leg 2;
cam 3 (not part of this invention);
vertical and horizontal adjustment ports 4;
cam axle mount 5;
limb to riser compression plate 6;
limb to riser compression plate bolt 7;
limb to riser compression plate bolt adjustment port 8;
fulcrum point 9;
flat limb Leg 10;
opposed flat limb leg 11;
string 12;
riser 13;
nut 14;
bolt 15;
flat limb expansion Area 16;
flat limb compression Area 17;
V-Limb expansion Area 18;
V-Limb compression Area 19.

Viewing FIG. 1, a side view of a traditional archery bow is shown having a riser 13 sandwiched between limbs 10 & 11, said limbs 10 & 11 attach by use of a compression fitting or bolt 7. At the opposite end of limb 10 & 11 away from riser 13 is a cam 3 on which a string 12 is placed around and attached to the opposing limb cam. Tension is applied to said compression bolt 7 and as said limbs pull on said string 12, tension is created upon said string 12.

Figure 2:
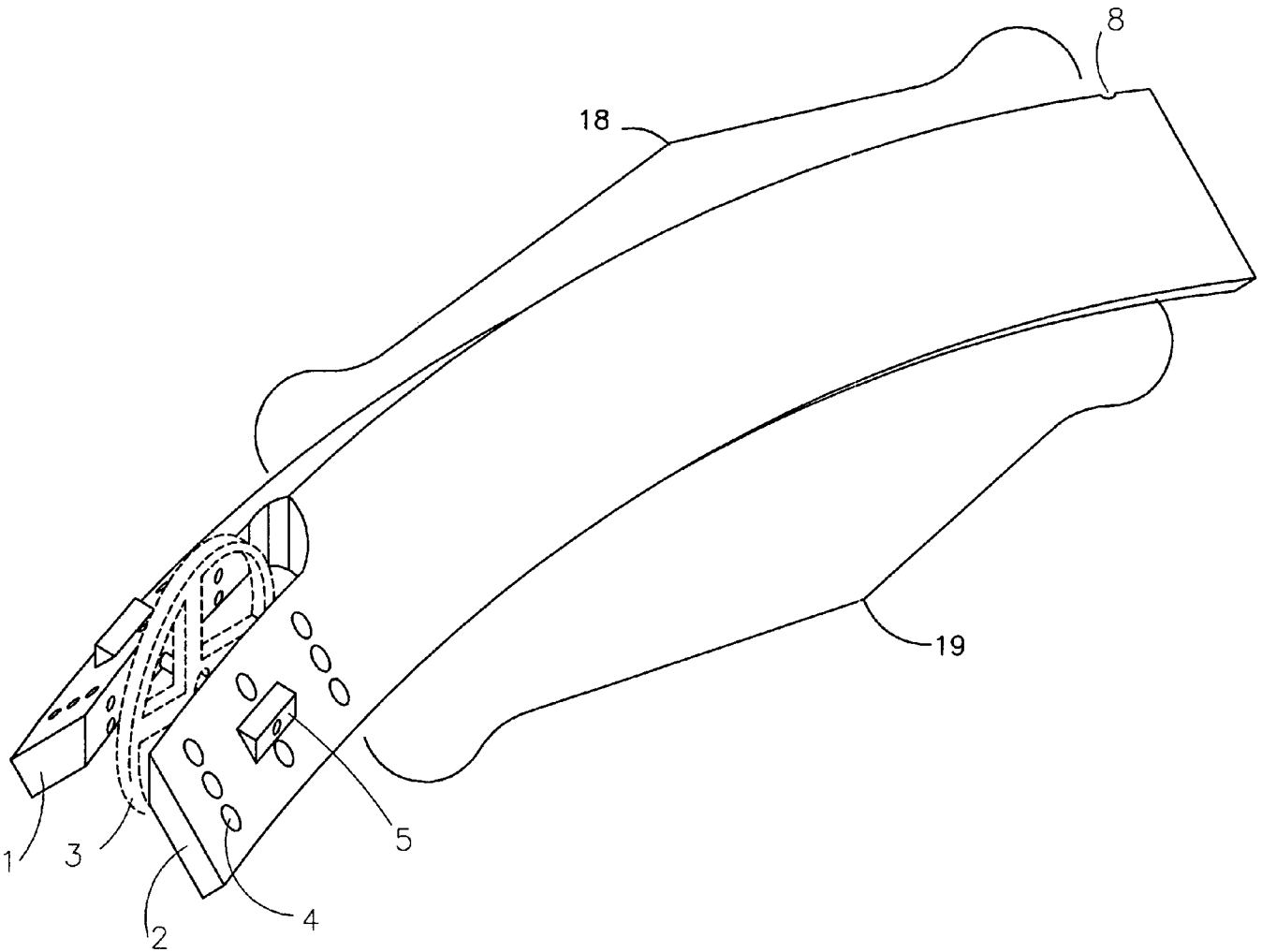
FIG. 2 is a perspective view of the invention without said limb to riser compression plate 6 and compression nut 7, viewed from the cam yoke end and showing said vertical and horizontal adjustment ports 4 and cam axle mount 5; and V-Limb expansion area 18 and V-Limb compression area 19.

In an opening embodiment and Viewing FIG. 2 said invention constructed of a ridged material such as but not limited to a dense, vibration absorbing material, rigidly molded, solid piece of a physically toughened structurally complementary substances, especially metals, ceramics, glasses, and polymers, combine to produce structural and functional properties not present in any individual component. Additionally viewed in FIG. 2 is V-Limb expansion area 18 and V-Limb compression area 19.

Yet in another embodiment all of said physically toughened structurally complementary substances are waterproof.

Figure 4:
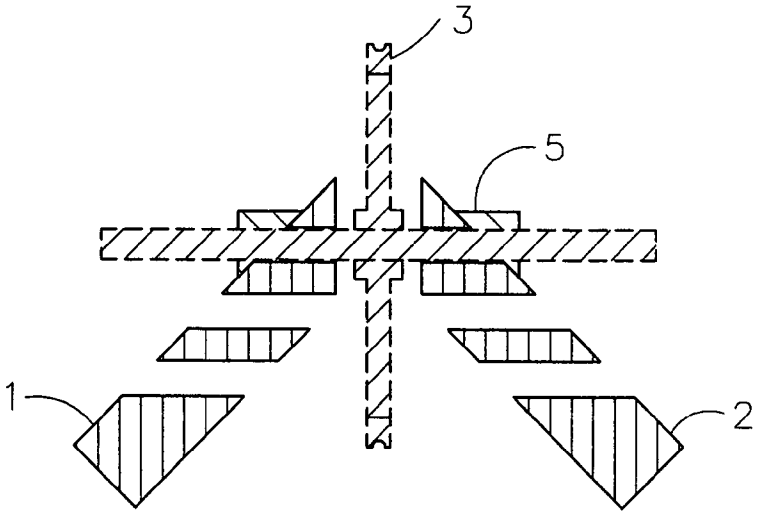
FIG. 4 is a cross-sectional view, viewed from the cam yoke end depicting said vertical and horizontal adjustment ports 4 and cam axle mount 5 with a cam module and shaft (not part of the invention) in a lower most and upper most position.
Figure 4:
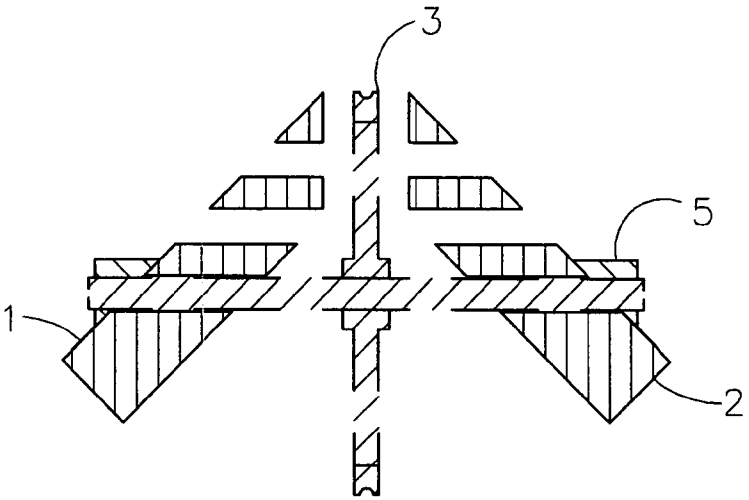

A further embodiment also viewed on FIG. 3, and FIG. 4, an adjustable axle to axle length. Shown limb leg 1 and opposed limb leg 2 and cam 3 (not part of this invention); and vertical and horizontal adjustment ports 4 and Cam axle mount 5 and having a convex or outward curvation extending parallel along the spine of said limbs 1 and 2, having a notch in one end capable of housing such as but not limited to an archery bow limb cam 3 module and having an archery bow riser mounting apparatus located opposite end Said said vertical and horizontal adjustment ports 4.

Figure 6:
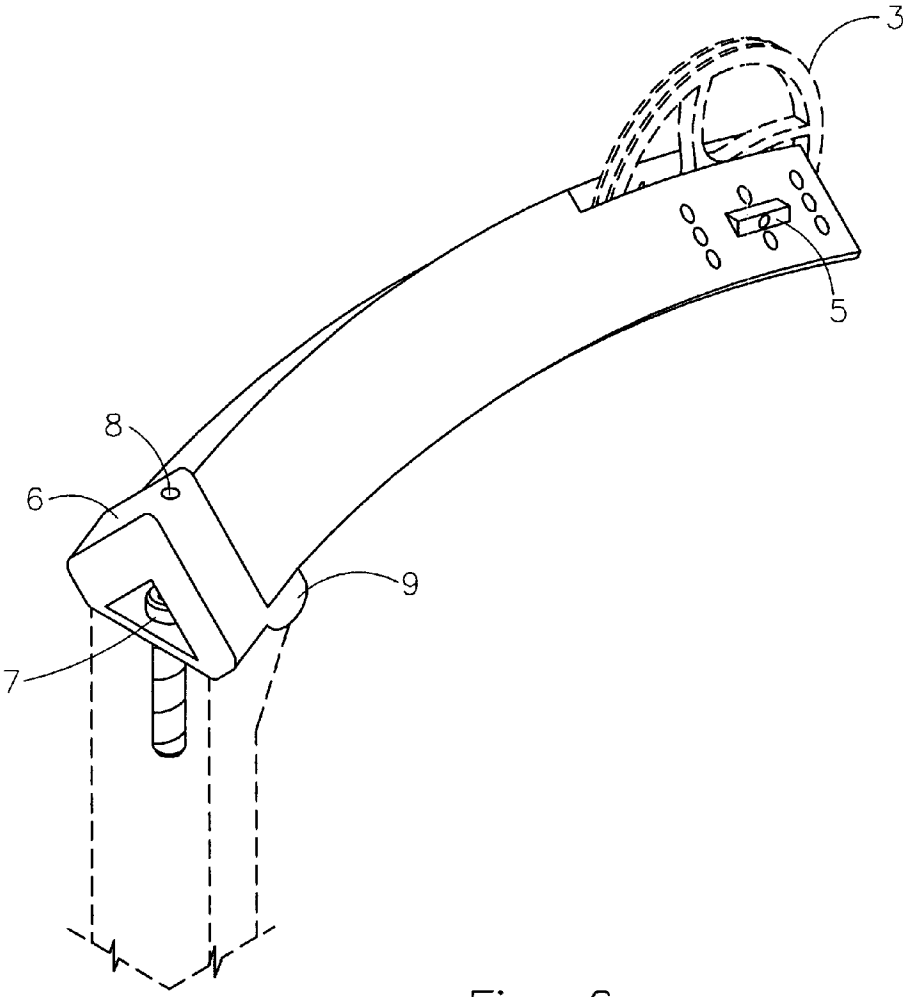
FIG. 6 is a perspective view of the preferred mounting of said invention with said limb to riser compression plate 6 and compression nut 7, viewed from the riser mount end and showing said vertical and horizontal adjustment ports 7 and cam module mounting slot with cam module in place (not part of this invention). Said invention can also be mounted and operated upon a traditional bow such as but not limited to FIG. 1.

An additional embodiment viewed on FIG. 6, describes said invention attaching by such as but not limited to, a limb to riser compression plate 6, limb to riser compression plate bolt 7 and limb to riser compression plate bolt adjustment port 8. As limb legs 1 and 2 are inserted into said limb to riser compression plate 6 and seated, an artisan inserts a tool into and through limb to riser compression plate bolt adjustment port 8 and either tightens or looses said bolt thus securing or removing said invention from said riser (not part of this invention). Also, said invention can be attached to many traditional archery bows by using the fulcrum point 9 located beneath said limb to riser compression plate 6 and behind said limb to riser compression plate bolt 7.

Figure 5:
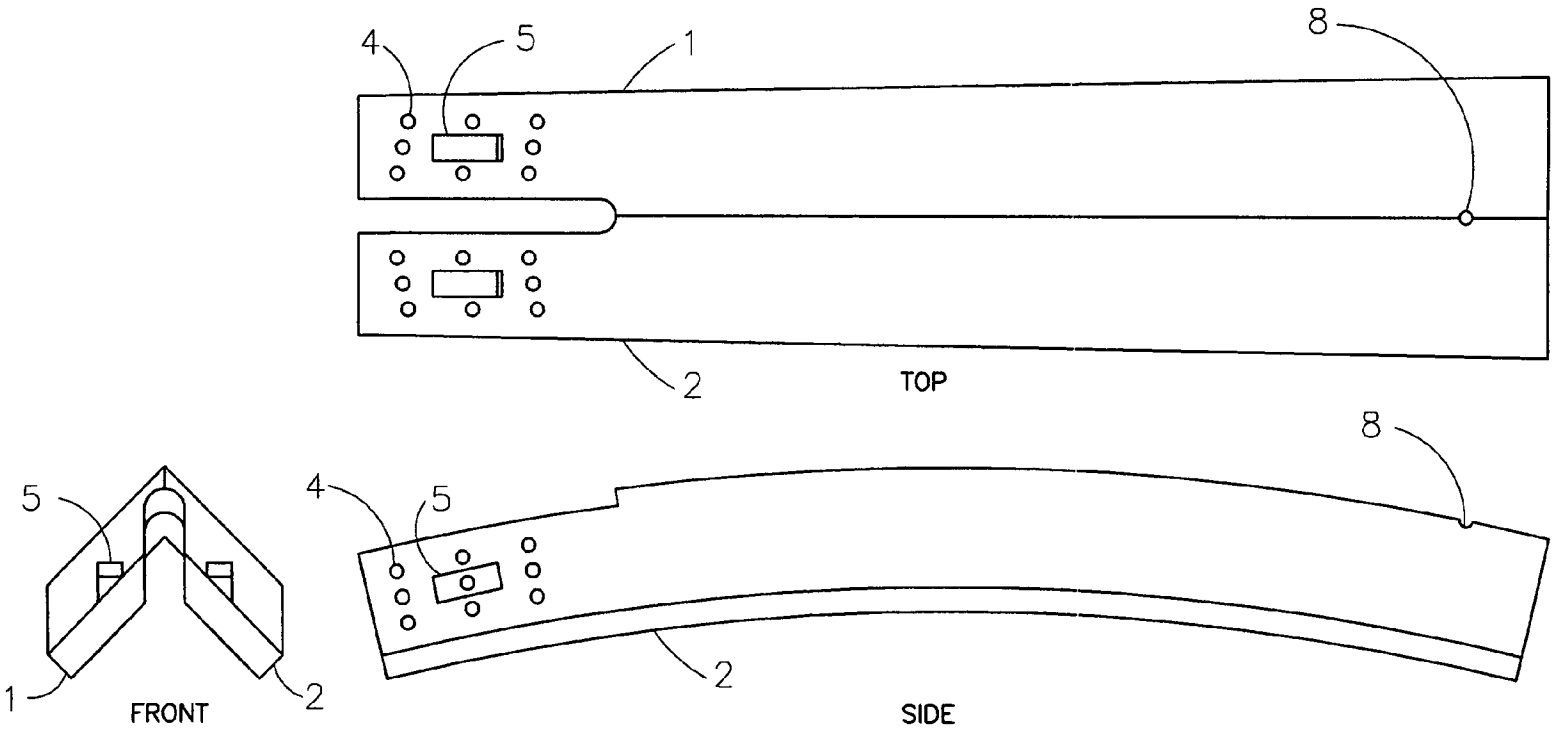
FIG. 5 is a top, front and side view showing the vertical and horizontal adjustment ports 4 and cam axle mount 5 and limb to riser compression bolt adjustment port 8.

Viewing FIG. 5, a further preferred embodiment is a description of the shape used to maximize spring return ratio such as but not limited to a sweeping arch. Viewing said invention from the top view, the reader can see the unique shape designed to create greater tension across the cross sectional shape thus transferring the potential energy into said string yielding a greater tension then traditional flat archery bow limbs.

Such a structural configuration provides the unexpected and unpredictable advantage of x-axis and y-axis rigidity while also providing a greater ratio of tension delivered to the archer's bow string over traditional flat limb technology currently used on archery equipment thus resulting in greater feet per second speed of the projectile.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the non-limiting exemplary embodiments may include variations in size, materials, shape, form, function and manner of operation.

What is claimed as new and what is desired to secure by Letters Patent of the United States is:

1. A sweeping and outwardly concavedly shaped archery bow V-Limb apparatus capable of being cantably mounted at or near the exterior extreme end of a bow riser for increasing the ratio of return tension to an archers string, said V-Limb comprising:

a first end, for attaching to a bow riser, having a limb to riser compression mounting plate and limb to riser compression plate bolt threaded fastener;

a second end with a notch therein defining a yoke for attaching a cam therein;

a convex lateral cross section defining two legs symmetrical about a central spine extending substantially a length of the V-Limb;

a plurality of corresponding adjustments ports in each of said legs in the area of said notch for vertical and/or horizontal adjustment of a cam within said notch.

* * * * *